United States Patent [19]

Matsuoka

[11] Patent Number: 4,720,281

[45] Date of Patent: Jan. 19, 1988

[54] DIVING BUOYANCY COMPENSATOR

[75] Inventor: Mitsushiro Matsuoka, Tokyo, Japan

[73] Assignee: Tabata Co., Ltd., Tokyo, Japan

[21] Appl. No.: 945,507

[22] Filed: Dec. 23, 1986

[30] Foreign Application Priority Data

Dec. 31, 1985 [JP] Japan ..... 60-297355

[51] Int. Cl.[4] ..... B63C 9/12

[52] U.S. Cl. ..... 441/92; 405/186; 441/106

[58] Field of Search ..... 441/88, 92, 94, 96, 441/106, 108–119; 114/315, 331, 332, 334; 405/185, 186, 187; 2/2.1 R, DIG. 3

[56] References Cited

U.S. PATENT DOCUMENTS

| | | | |
|---|---|---|---|
| 4,016,616 | 4/1977 | Walters | 114/315 X |
| 4,045,835 | 9/1977 | Flam et al. | 441/106 X |
| 4,229,832 | 10/1980 | Dickson, Sr. | 2/2.1 R |
| 4,379,656 | 4/1983 | Darling | 405/186 |

FOREIGN PATENT DOCUMENTS

| | | | |
|---|---|---|---|
| 29098 | 3/1977 | Japan | 405/186 |

*Primary Examiner*—Joseph F. Peters, Jr.
*Assistant Examiner*—Paul E. Salmon
*Attorney, Agent, or Firm*—Fred Philpitt

[57] ABSTRACT

Here is disclosed a diving buoyancy compensator being capable of regulating a buoyance of a diver and achieving rapid flotation of the diver in case of emergency. The compensator is equipped with a safety valve device adapted to be automatically opened when the compensator has been filled with an excessive quantity of air and, in the case of emergency, adapted to be opened through manual operation by the diver, to exhaust the quantity of air filling the compensator. The safety valve device includes an operating mechanism mounted in an air inlet port provided in the compensator to which an inflation hose capable of expansion and contraction is connected at one end. A pull cord connecting a portion of the operating mechanism to a portion of a power inflator carried on the other end of the hose extends through the hose so that the hose may be expanded to open the safety valve device through the pull cord.

3 Claims, 11 Drawing Figures

DIVING BUOYANCY COMPENSATOR

BACKGROUND OF THE INVENTION

The present invention relates to a diving buoyancy compensator and, more particularly, to a jacket or a vest for buoyancy compensation or stabilization and emergency flotation of a diver during diving.

As well known, the buoyancy compensator is used as auxiliary means for buoyancy compensation or stabilization and emergency flotation of a diver during scuba diving. Such compensator is generally provided with a power inflator and a safety valve device. The power inflator includes an inlet button, an exhaust button and a mouthpiece, and is connected through a first inflation hose to the compensator, on one side, and through a second inflation hose, to an air tank carried by the diver on the back on the other side. The diver may depress the inlet button to supply air stream from the air tank through the second inflation hose and the first inflation hose into the compensator and depress the exhaust button to exhaust air from the componsator through the first inflation hose. Obviously, it is also possible to make air supply by expiration of the diver from the mouthpiece through the first inflation hose into the compensator. The safety valve device is adapted to be automatically opened when the compensator is excessively filled with air to exhaust such excessive quantity of air and includes a mechanism which may be manually operated by the diver in the case of emergency also for such exhaustion.

In the conventional compensator of this type, the first inflation hose of the power inflator is connected at its base end to one shoulder of the compensator and the safety valve device is carried on the other shoulder of the compensator. And this safety valve device is provided with a pull rope of which the one end is directly connected to the safety valve device, the intermediate portion extends along a collar of the compensator and the opposite end is hung down so that this rope may be pulled down to open the safety valve device and thereby to achieve exhaustion.

With the conventional compensator of this type, the compensator must be provided not only with a port (air inlet) to which the first inflation hose of the power inflator is connected at its base end but also another port (air outlet) in which the safety valve device is mounted. With a consequence, provision of the port exclusively for mounting of the safety valve device correspondingly complicates manufacturing of the compensator and often causes various accidents such as air leakage and tearing to occur from this port exclusively for mounting of the safety valve device. Accordingly, it is desired to minimize such a region of the compensator to be worked.

A principal object of the present invention is to provide a diving buoyancy compensator so improved that the air inlet port to which the first inflation hose of the power inflator essential to such compensator is connected at the base end may be utilized for mounting of the safety valve device.

SUMMARY OF THE INVENTION

This object is achieved, in accordance with the present invention, the safety valve device is juxtaposed with a coupling of the first inflation hose connected to the air inlet port of the compensator.

The safety valve device of this invention is different from that of prior art so far as its mechanism is concerned but adapted in the same manner as that of prior art to be automatically opened, when the compensator is excessively filled with air, to relieve such excessive quantity of air and adapted to be manually operated by the diver in the case of emergency for the similar purpose. This safety valve device includes an operating mechanism to open the valve and said mechanism is provided with a pull cord by which the driver manipulates said mechanism. This pull cord extends from said operating mechanism through the first inflation hose which is capable of expansion and contraction in a manner of bellows to the power inflator carried on the tip of said hose and anchored thereto. The safety valve device further includes effective means for interception of water.

According to the present invention provided with such safety valve device, there is no necessity for provision of a separate port in which the safety valve device is mounted. Such feature is significant in that the manufacturing processes, such as working of the compensator so as to equipped with various parts relating to the compensator and affixing of these parts to the compensator, are effectively simplified in comparison to the case of the conventional compensator of this type and furthermore it is possible to eliminate the undesirable factor causing air leakage and tearing damage occurring around the port in which the safety valve device is mounted. Furthermore, the safety valve device is adapted to be opened to relieve any excessive quantity of air out of the compensator when the first inflation hose is expanded and, in consequence, a pulling force functioning to actuate said operating mechanism is transmitted to said pull cord. Accordingly, the safety valve device according to the present invention is easily manipulated without any misfunction and expected to appropriately accommodate the emergency requiring that any excessive quantity of air within the compensator should be rapidly expelled out.

PREFERRED EMBODIMENT OF THE INVENTION

Figure 1:
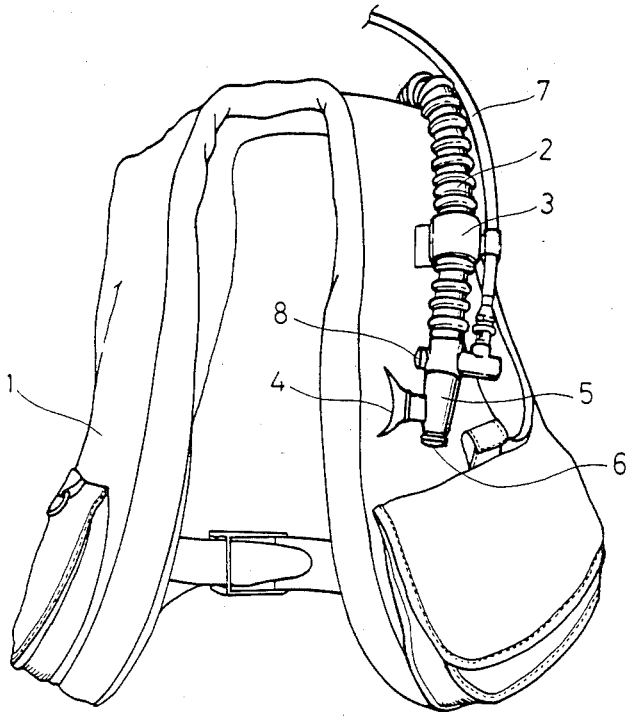
FIG. 1 is front view showing a buoyancy compensator (jacket or vest) of the present invention.
Figure 2:
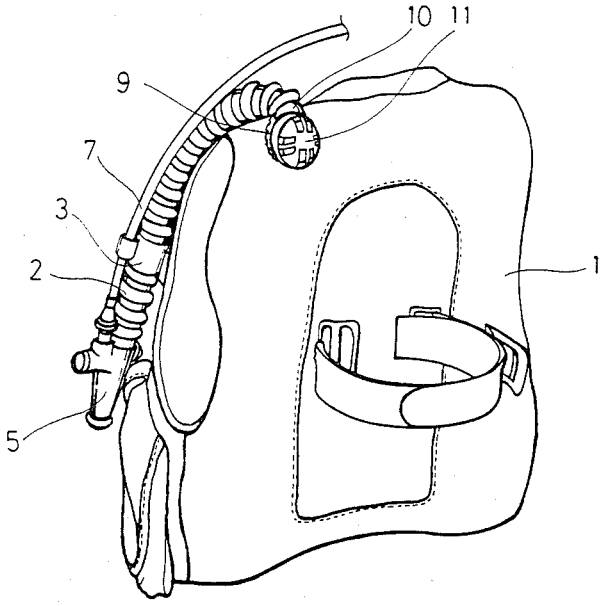
FIG. 2 is a rear view showing said compensator.

Referring to FIGS. 1 and 2, a jacket or a vest as a buoyancy compensator 1 is made of suitable sheet material having air-tight, water-proof property and removably carries by use of a clip 3 a first inflation hose 2 being capable of expansion and contraction in a manner of bellows. The hose 2 is provided at its tip with a power inflator 5 including a mouthpiece 4. The power inflator 5 further includes an exhaust button 6 and an inlet button 8. To the power inflator 5, one end of a second inflation hose 7 is connected. The other end of said hose 2 is connected to a coupling 9 mounted in an air inlet port provided in one shoulder of the compensator 1. On a top surface of the coupling 9, there is juxtaposed a mount member 10 for a safety valve device as will be described later and this mount member 10 is provided with a cap put thereon.

Figure 3:
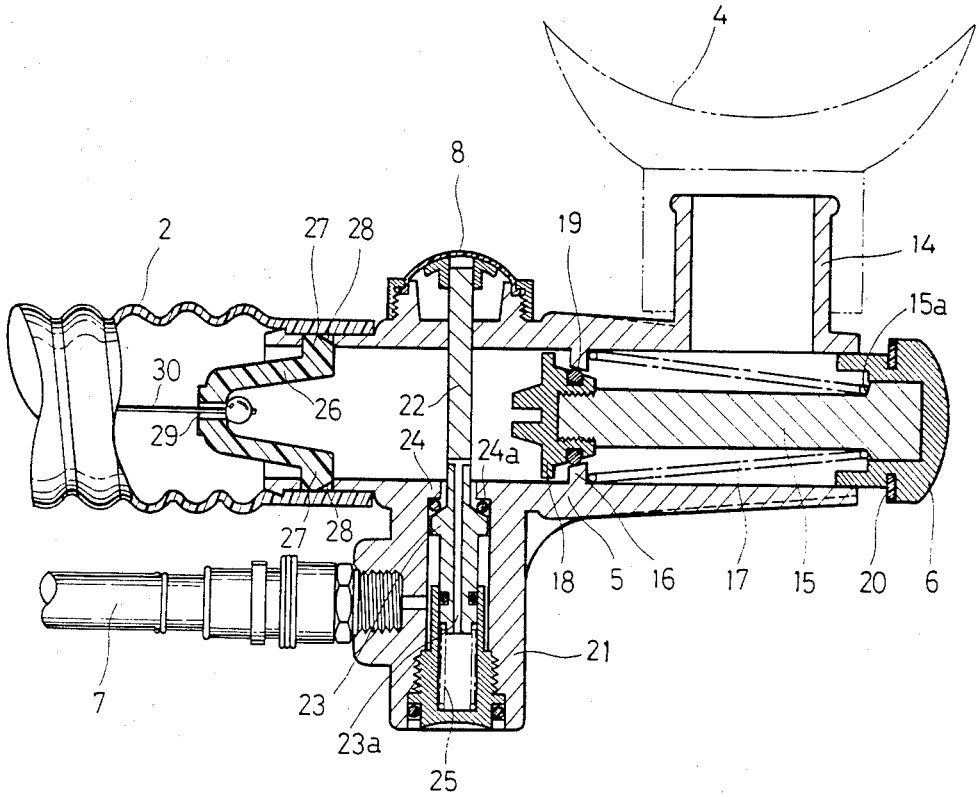
FIG. 3 is a side view showing, partially in a longitudinal section, a power inflator.

Referring to FIG. 3, there is illustrated the power inflator 5 which is of the well known construction and, therefore, will be briefly described here. The power inflator 5 comprises a cylindrical projection 14 carrying thereon the mouthpiece 4, a valve stem 15 provided at its tip with the exhaust button 6 put thereon and outwardly biased under an expanding force of a coil spring 17 extending between a stepped portion 15*a* and a base portion of a valve-seat 16 formed in inner wall of the inflator 5, and a valve 18 threaded on the inner end of the valve stem 15 so as to be normally pressed against the valve seat 16 and thereby to be kept closed. The surface of this valve 18 that is pressed against the valve seat carries a packing 19 and the surface of the exhaust button 6 that is pressed against the inflator 5 carries a packing 20. The valve 18 normally closed as shown is moved leftwards as viewed in FIG. 3 against the action of the spring 17 under an influence of the diver's expiration supplied through the mouthpiece 4 and thus the valve 18 is opened. With a consequence, the exhaust button 6 is pressed against the end surface of the inflator 5, causing the diver's expiration to be supplied through the hose 2 into said compensator 1. The same valve 18 functions also as an exhaust valve which may be manually operated to exhaust the quantity of air filling the compensator 1. More specifically, the exhaust button 6 may be depressed against the expanding force of the spring 17 to move the valve 18 away from the valve-seat 16 and thereby to exhaust the quantity of air filling the compensator 1 back through the hose 2 and the mouthpiece 4. It should be noted here that a flow rate of the exhaust air is appropriately restricted by a limited gap defined by the valve 18 and that such exhaustion is under control by depression of the button 6, permitting an air filling pressure within the compensator 1 to be finely adjusted thereby.

The second inflation hose 7 is connected to another cylindrical projection 21 of the inflator 5. Within this cylindrical projection 21, a valve 23 having its associated valve stem 22 integrally fixed to the inlet button 8 made of a semispherical rubber cup or the like is pressed under an expanding force of a coil spring 25 against a valve-seat 24 formed in a base portion of said cylindrical projection 21. This valve 23 is normally pressed under the expanding force of said spring 25 against the valve-seat 24 carrying a packing 24*a* and thereby held closed. Upon depression of the button 8 against the expanding force of the spring 25, the valve 23 is moved away from the valve-seat 24 and thereby opened. Then, compressed air is supplied from the air tank (not shown) carried by the diver through the hose 7 into the inflator 5, then through the hose 2 into the compensator 1. The valve 23 is provided with an air passage 23*a* to maintain a ventilation of a chamber in which the spring 25 is disposed.

According to the present invention, the inflator 5 of the construction as has been mentioned above further includes a locking member 26 comprising a U-shaped member made of elastic material such as metal and hard plastic and having pawls 27 on opposite side edges, respectively, and said pawls 27 are maintained in engagement into associated receiving holes 28 formed in the inflator 5 under the elasticity of this locking member 26 itself. This locking member 26 is provided in its top with a small hole 29 into which a tip of a pull cord 30 as will be described later and is anchored.

Figure 4:
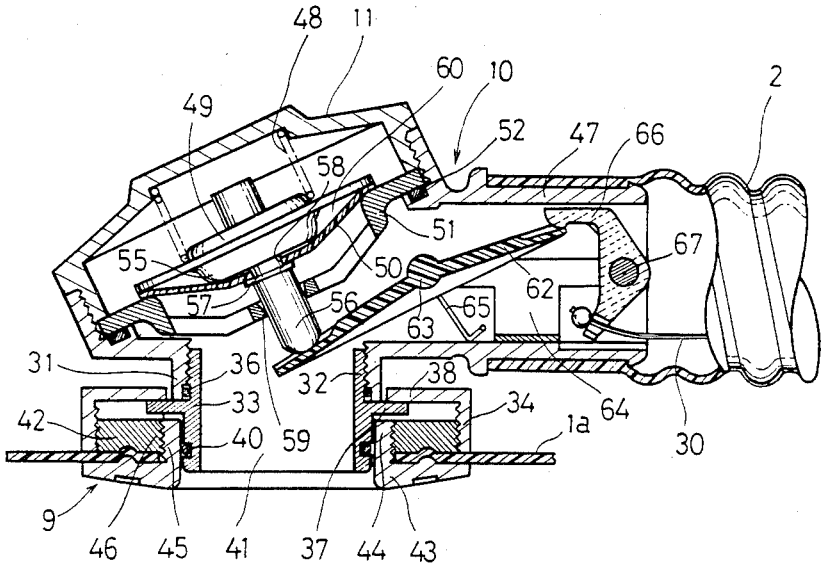
FIG. 4 is a side view showing, partially in a longitudinal section, a safety valve device.
Figure 5:
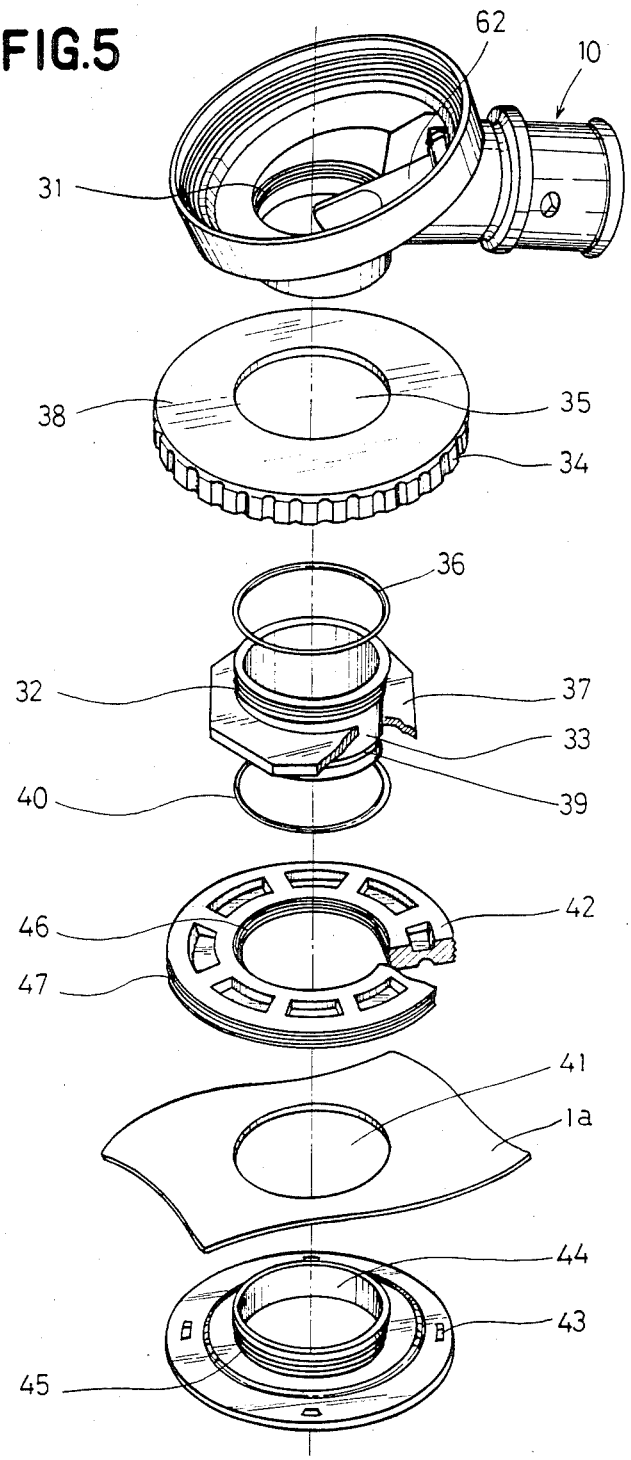
FIG. 5 is a disassembled perspective view showing a coupling in which said safety valve device is incorporated and a base end of a first inflation hose is mounted.
Figure 6:
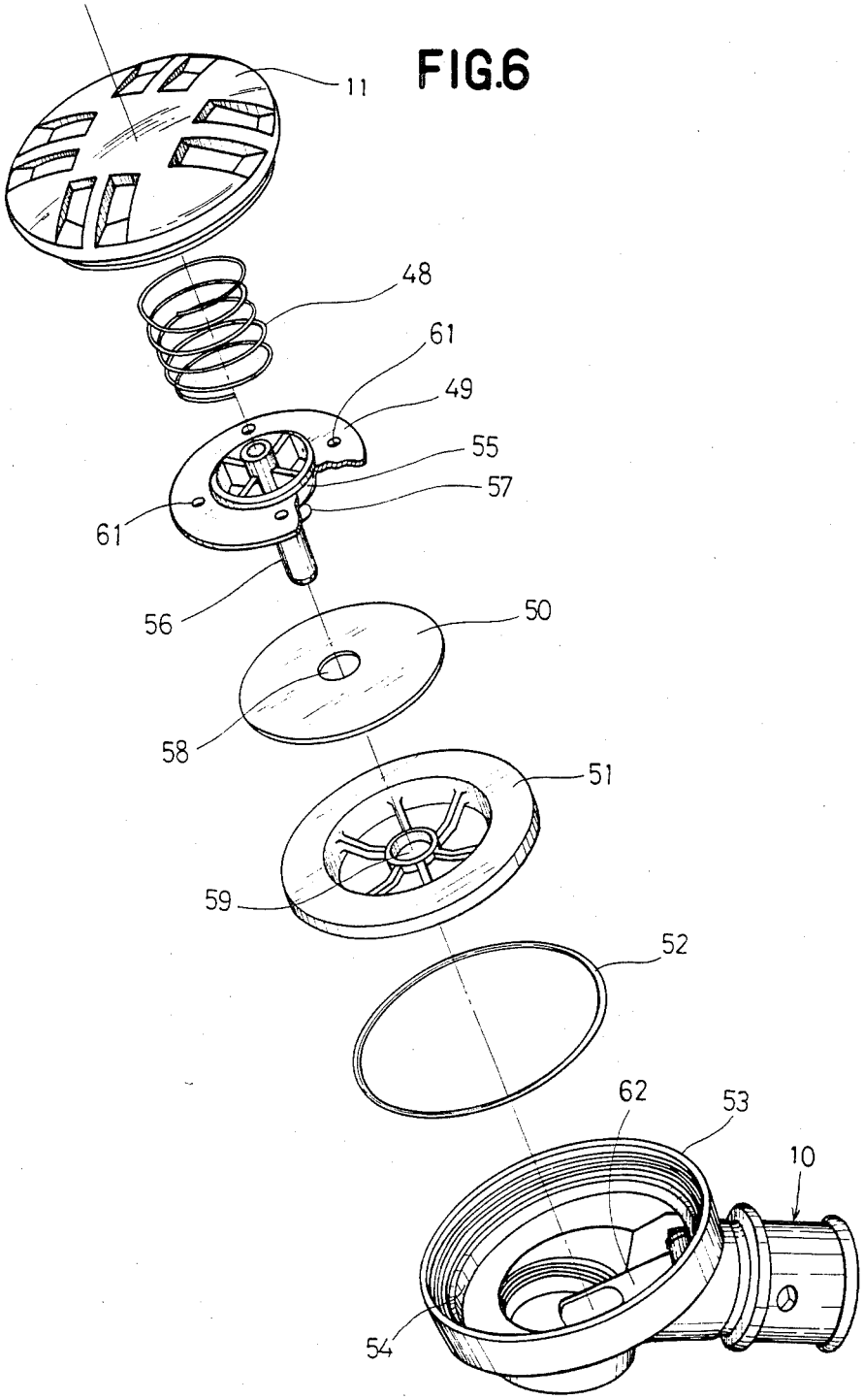
FIG. 6 is a disassembled perspective view showing said safety valve device.

As will be seen in FIGS. 4 and 5, the coupling 9 is mounted in an air inlet port 41 which is provided in the right side sheet 1*a* of the compensator 1. The coupling 9 consists of a cylindrical member 33 and annular members 34, 42, 43. The annular member 43 includes a cylindrical portion 44 of a same diameter as the air inlet port 41 and inserted into the air inlet port 41. Therearound, inner and outer peripheries of the annular member 42 are thread-secured. A cylindrical projection 31 of the mount member 10 is threaded on a upper portion of the cylindircal member 33 of which a flange 37 is brought into contact with a flange 38 of the annular member 34. And the cylindrical member 33 carries on it outer periphery upper and lower packings 36, 40. In this way, the cylindrical member 33 is rotatable relative to the annular members 34, 43.

A cylindrical portion 47 of the mount member 10 is mounted on the end of the hose 2 and said mount member 10 is incorporated with the safety valve device comprising the perforated cap 11, a coil spring 48, a valve 49, a flexible sheet 50, a perforated valve-seat 51 and an O-ring 52. More specifically, the O-ring 52 is disposed on a bottom edge 54 formed in the port 53 of the mount member 10 and the valve-seat 51 is placed on said O-ring. The circular valve 49 has a boss 55 formed concertrically with the valve 49 and projecting from the lower side (i.e., valve-seat side) by a height of approximately 5 mm and a valve stem 56 extending from a centre of said boss 55. This valve stem 56 is inserted through a central hole 58 formed through the flexible sheet 50 made of silicone rubber or the like which is shaped as a disc substantially same in diameter as said valve 49 and in order of 2 mm in thickness, said valve stem 56 is further inserted through said central hole 58 until a flange 57 formed around a base portion of said valve stem 56 also passes through said central hole 58 by forcing said sheet 50 to yield under its own elasticity and thereby the circumferential edge of said central hole 58 is tightly held between said flange 57 and the top surface of said boss 55, and then inserted through a stem receiving hole 59 formed through the valve-seat 51 so as to be somehwat tapered or diameter-enlarged outwardly. Finally, the cap 11 is threaded in the port 53 with interposition of the coil spring 48. The safety valve device thus assembled and incorporated into the mount member 10 is normally maintained air-tight since the valve 49 is pressed by the expanding force of the coil spring 48 against the valve-seat 51 with interposition of the flexible sheet 50. When said compensator 1 reached an excessively airfilled condition, a pressure of filling air at this moment overcomes a valve pressure under the action of the spring 48. As a result, the valve 49 is urged upwards and thereby opened so that the quantity of air filling the compensator is partially discharged through a relatively wide area of the gap established between the valve-seat 51 and the flexible sheet 50. At this moment, the flexible sheet 50 serving as a packing so long as the valve is maintained in its closed position presents a special function. Specifically, once the valve 49 has been opened, the gap between the flexible sheet 50 and the valve-seat 51 is no more uniform in the circumferential direction due to factors such as a play occurring between the valve stem 56 and the stem receiving hole 59. It is for this reason that, particularly in water, said quantity of air filling the compensator 1 is discharged locally or discontinuously through said gap in the form of air bubbles. The flexible sheet 50 has its central portion lifted by boss 55 formed on the underside of the valve 49 off the valve 49 and a chamber 60 thus defined between the valve 49 and said sheet 50 communicates through a small holes 61 with the exterior. In view of such situation, it will be apparent that the sheet 50 tends to remain at the side of the valve-seat 51 under its own elasticity tending to bring the sheet 50 back to its planar posture, when the valve 49 is moved away from the valve-seat 51. Accordingly, the air bubble partially urges the area of the flexible sheet 50 remaining on the side of the valve-seat 51 and thereby discharged. The rest area of said sheet 50 now functions to prevent water from flowing into the mount member 10 and, therefore, into the compensator 1 through the region around the valve-seat 51 that is free from occurrence of bubble spouting.

Figure 7:
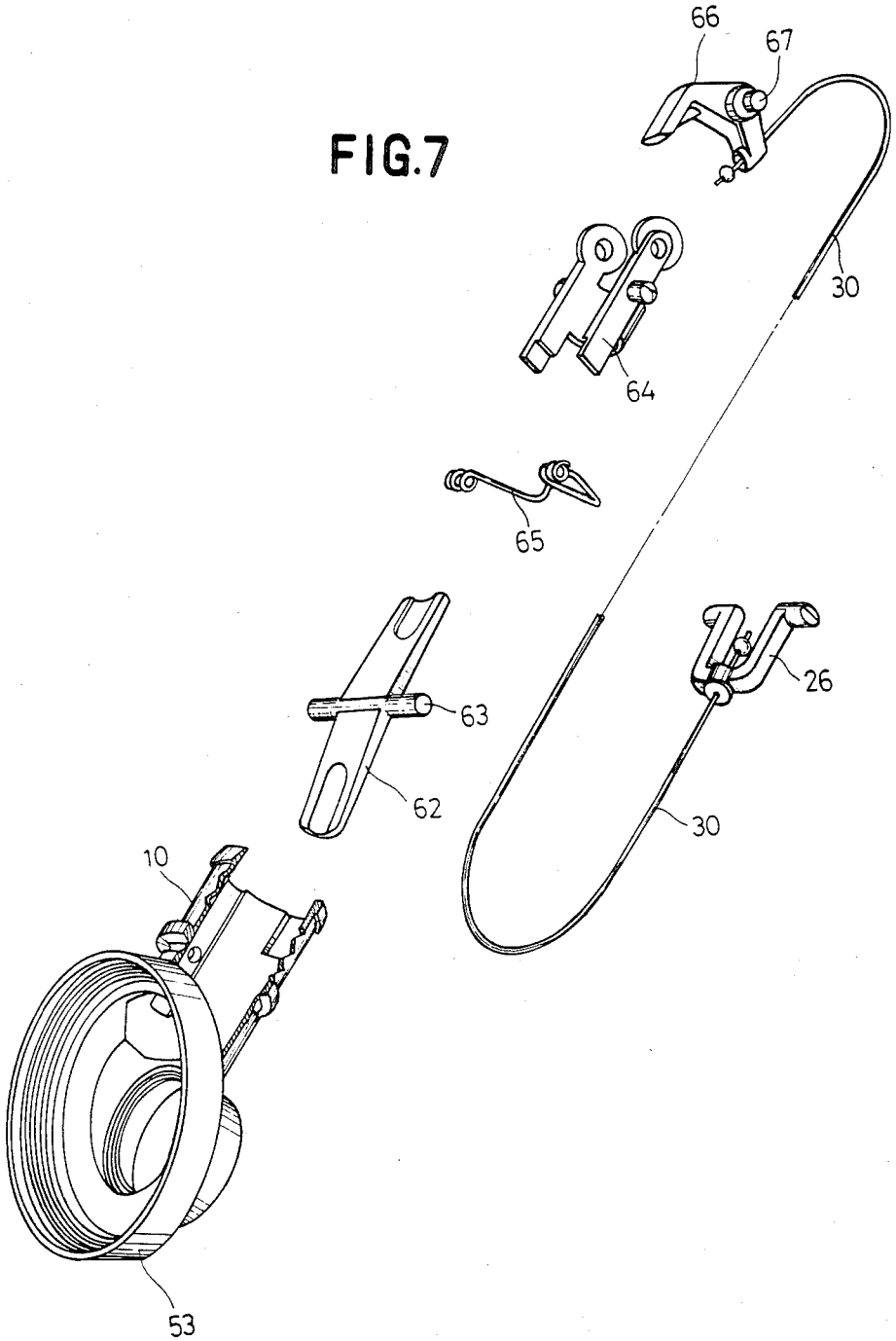
FIG. 7 is a disassembled perspective view showing a manually actuated mechanism of said safety valve device.
Figure 8:
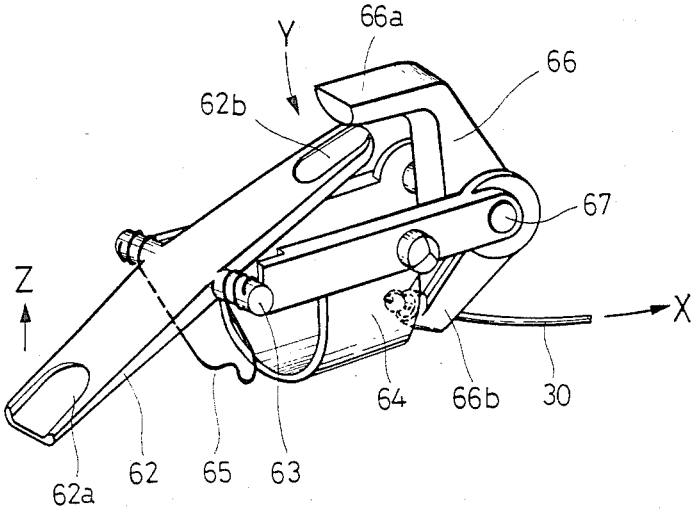
FIG. 8 is a perspective view showing said operating mechanism in a partially incorporated condition.

As will be best seen FIGS. 4, 7 and 8, the safety valve device is adapted to be forcibly opened by the diver. To achieve this, a lever 62 is supported by an intermediate shaft 63 around which a spring 65 is mounted between opposite walls within the mount member 10 is so that the tip of the valve stem 56 is opposed to one end **62*a* of said lever 62, and a link lever 66 is rotatably supported by a support member 64. One end 66*a* of this link lever 66 is engaged with the other end 62*b* of said lever 62 and one end of said pull cord 30 is connected to the other end 66*b* of said lever 66. This pull cord 30 extends through the hose 2 to the locking member 26 of said inflator 5. To effect a buoyancy reduction by rapidly exhausting the quantity of air filling the compensator 1 in the case of emergency, the inflator 5 may be grasped and pulled down (see FIG. 1) to expand the hose 2 and thereby to pull the cord 30 in a direction as indicated by an arrow X as seen in FIG. 8. The link lever 66 to which the pull cord 30 is connected at this one end is thereby rotated around its shaft 67 counterclockwise as viewed in FIG. 8 and the other end 66*a* of said link lever 66 urges the end 62*b* of the lever 62 down in a direction as indicated by an arrow Y, resulting in that the other end 62*a* of said lever 62 is rotated in a direction as indicated by an arrow Z. The end 62*a* of said lever 62 urges, in turn, the valve stem 56 upwards against the action of the coil spring 48 so as to move the valve 49 away from the valve-seat 51 at once. In consequence, the quantity of air filling the compensator 1 is rapidly exhausted through the perforated cap 11**.

Figure 9:
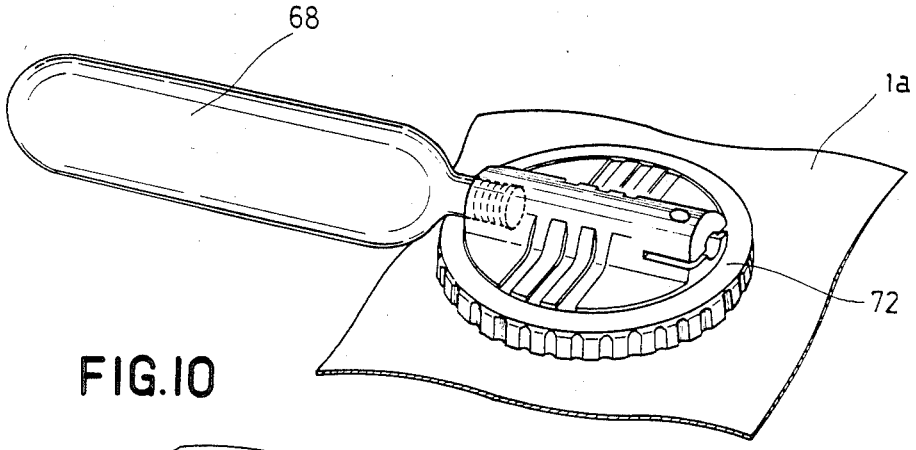
FIG. 9 is a perspective view showing $CO_2$ gas cylinder.
Figure 10:
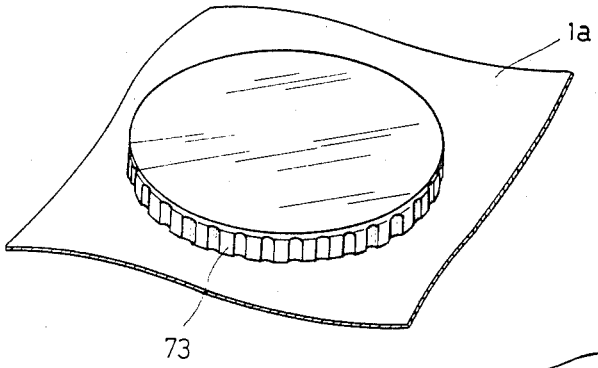
FIG. 10 is a perspective view showing a seal cap mounted in the place of said $CO_2$ gas cylinder.
Figure 11:
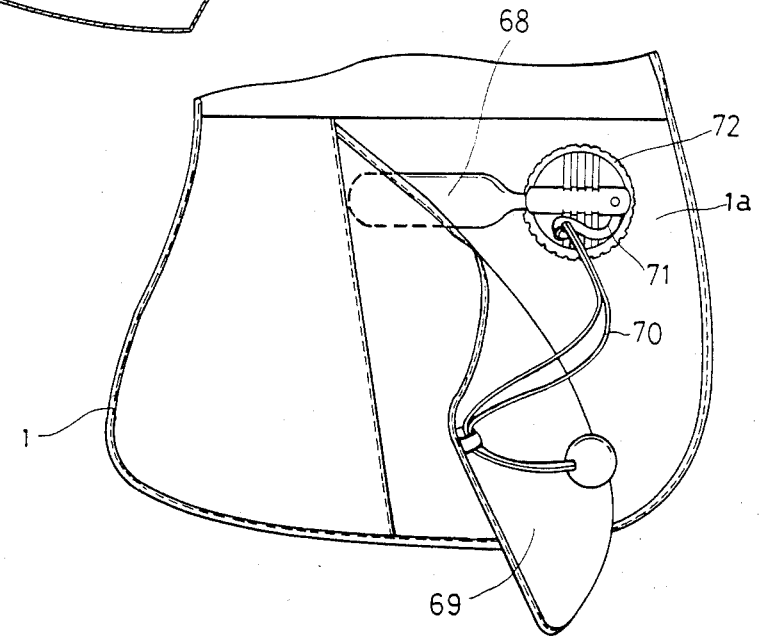
FIG. 11 is a perspective view showing a portion of the compensator around a mount for the $CO_2$ gas cylinder.

Finally, in reference with FIGS. 9 through 11, the conventional compensator of this type has been so constructed that a pressurized $CO_2$ gas cylinder 68 serving as a double safety means may be mounted by a mounting cap 72 in a mount port (not shown) provided in the right side sheet **1*a* of the compensator behind a pocket 69. With this arrangement, a manipulation cord 70 for a valve opening lever 71 may be pulled to inflate the compensator 1 at one with $CO_2$ gas spouting from the cylinder 68. However, the compensator of the present invention which is provided with a double air supply measure, i.e., means for air supply relying on expiration of the diver and means for air supply through the exhaust port can already accommodate a possible emergency effectively and, therefore, there is substantially no demand for said cylinder 68. Thus, according to the present invention, a seal cap 73, instead of said cap 72, may be mounted in said mount port to utilize said mount port as a drain hole for washing water of the compensator 1**.

What is claimed is:

1. A diving buoyancy compensator including a compensator itself, a first inflation hose having first and second ends and a tendency to contract being capable of expansion and contraction and having one end connected through a coupling to an air inlet port formed in said compensator itself, a power inflator carried on the other end of said first inflation hose, a second inflation hose having first and second ends having one end connected to said inflator and the other end adapted to be connected to an air tank, and a safety valve device adapted to be automatically opened when said compensator has been filled with an excessive quantity of air and also adapted to be opened through manual operation by a diver, in case of emergency, so as to relieve the quantity of air filling said compensator, wherein said inflator includes a mouthpiece, a button to operate a valve adapted to open and close an air passage within said inflator extending between said first inflation hose and said second inflation hose, and another button to operate a valve adapted to open and close an air passage within said inflator extending between said first inflation hose and said mouthpiece, characterized by that said safety valve device is incorporated into a mount member coupled to said coupling to which the one end of said first inflation hose is connected, an operating mechanism for said safety valve device is juxtaposed with said mount member, a pull cord for actuation of said operating mechanism is connected at one end to a portion of said operating mechanism and extends through said first inflation hose into said inflator to be connected thereto, said first inflation hose is expanded against its tendency to contract and thereby said pull cord is pulled so as to open said safety valve device through said operating mechanism.

2. A diving buoyancy compensator according to claim 1, wherein said safety valve device comprises a valve biased by a spring to be normally closed, an associated valve-seat and a flexible sheet interposed between said valve and said valve-seat with a central portion of said flexible sheet being supported so as to be spaced from said valve.

3. A diving buoyancy compensator according to claim 1, wherein said operating mechanism comprises a lever member adapted to open said valve against a force biasing said valve to be normally closed, a link lever adapted to actuate said lever member and said pull cord of which the one end is connected to said link lever.

* * * * *